US006032504A

United States Patent [19]

Onat et al.

[11] Patent Number: 6,032,504

[45] Date of Patent: Mar. 7, 2000

[54] DRAW STAMPING DIE FOR STAMPING BODY PANELS FOR MOTOR VEHICLES

[75] Inventors: Ziya Y. Onat, Scarborough; Raymond A. Musson, Burlington, both of Canada

[73] Assignee: Cosma International Inc., Ontario, Canada

[21] Appl. No.: 09/172,680

[22] Filed: Oct. 15, 1998

Related U.S. Application Data

[60] Provisional application No. 60/062,207, Oct. 16, 1997.

[51] Int. Cl.[7] ..... B21D 11/02; B21D 22/22

[52] U.S. Cl. ..... 72/297; 72/309; 72/350

[58] Field of Search ..... 72/297, 296, 304, 72/308, 309, 414, 403, 350, 351

[56] References Cited

U.S. PATENT DOCUMENTS

| | | | |
|---|---|---|---|
| 2,002,097 | 5/1935 | Peterson . | |
| 2,064,160 | 12/1936 | Hochreiter | 113/46 |
| 2,294,451 | 9/1942 | Ernst | 113/45 |
| 3,124,340 | 3/1964 | Williamson | 267/1 |
| 3,147,722 | 9/1964 | Williamson | 113/42 |
| 3,202,411 | 8/1965 | Heiser | 267/1 |
| 3,279,780 | 10/1966 | Williamson | 267/1 |
| 3,425,257 | 2/1969 | Heiser | 72/297 |
| 4,358,263 | 11/1982 | Shiraishi et al. | 425/397 |
| 4,977,774 | 12/1990 | Asari et al. | 72/456 |
| 5,600,991 | 2/1997 | Munzen | 72/350 |

FOREIGN PATENT DOCUMENTS

| | | | |
|---|---|---|---|
| 724433 | 12/1965 | Canada | 113/45 |
| 890701 | 1/1972 | Canada | 113/69 |
| 2 646 623 | 11/1990 | France . | |
| 59-163032 | 9/1984 | Japan . | |
| 2-207927 | 8/1990 | Japan . | |
| 4-178225 | 6/1992 | Japan . | |

*Primary Examiner*—Daniel C. Crane
*Attorney, Agent, or Firm*—Pillsbury Madison & Sutro LLP

[57] ABSTRACT

A method and apparatus for forming an exterior body panel for a motor vehicle. The method comprises mounting a sheet of metal material in a die assembly, clamping first peripheral portion of the sheet of metal material between clamping surfaces of the die assembly, moving the clamping surfaces relative to a central die structure so as to deform the sheet metal over the central die structure, clamping second peripheral portion of the sheet of metal material between a die pad of the die assembly and the central die structure after the sheet metal is deformed over the central die structure, moving the clamping surfaces relative to the central die structure to stretch the sheet metal over the central die structure after the second peripheral portion of the sheet of metal material are clamped, and stamping the sheet of metal material between the central structure and an opposing die surface after the sheet metal has been stretched over the die structure so as to provide the sheet metal with a desired configuration.

18 Claims, 7 Drawing Sheets

DRAW STAMPING DIE FOR STAMPING BODY PANELS FOR MOTOR VEHICLES

This application is related to provisional application Ser. No. 60/062,207, filed Oct. 16, 1997.

The present invention relates to stamping dies and methods for stamping sheet metal to for outer body panels for motor vehicles.

It is known in the art to draw form sheet metal and stamp the same to form various metal parts. In conventional draw forming or stamping operations, the sheet metal is peripherally clamped and then stretched over a fixed die structure before it is stamped into a desired configuration. Stretching the metal material prior to stamping work-hardens the material so that a stronger part can be made with less metal material being required.

Such technology has been implemented in the automotive industry, for example, in manufacturing interior body panels. Heretofore, however, draw forming or draw stamping sheet metal that can be used for outer body panels has been commercially unsuccessful. Specifically, the draw forming and stamping operations have conventionally produced parts that are not suited to be used for applications requiring "class A" surface finishes, such as what is required for outer body panels. More specifically, conventional draw forming operations impart stretch marks, scratches, and other irregularities to the part that make the part unsuitable for exterior body panels.

It is an object of the present invention to provide a stamping die assembly that can be used to manufacture exterior body panels. In accordance with this object, the present invention provides a die assembly for draw stamping sheet metal in a press for forming an exterior body panel for a motor vehicle, the die assembly comprises a first die assembly including a central first die structure that engages one surface of the sheet metal during a stamping operation. The first die assembly further includes a movable peripheral clamping structure which is movable with respect to the first die structure and constructed and arranged to engage first peripheral portion of the sheet metal. A second die assembly is provided and includes a second die structure having a central stamping surface that engages an opposite surface of the sheet metal during the stamping operation. The second die structure includes a peripheral clamping surface constructed and arranged to cooperate with the movable clamping structure to clamp the first peripheral portion of the sheet metal therebetween. The second die assembly further includes a movable die pad which is movable with respect to the second die structure. The movable die pad is cooperable with the first die structure to clamp second peripheral portion of the sheet metal therebetween. The second die assembly is movable by a press so that the peripheral clamping surface thereof cooperates with the movable clamping structure of the first die assembly to clamp the first peripheral portion of the sheet metal therebetween. The peripheral clamping surface and the movable clamping structure are moved with the first portions of sheet metal clamped therebetween to deform the sheet metal over the central first die structure. The movable die pad is movable relative to the second die structure and towards the first die structure so as to clamp the second portions of the sheet metal between the movable die pad and the first die structure after the sheet metal is deformed over the central first die structure. The peripheral clamping surface and the movable clamping structure can be moved to stretch the sheet metal over the central first die structure, and the central stamping surface is cooperable with the central first die structure of the second die structure to stamp the sheet metal therebetween after the sheet metal has been stretched over the central first die structure so as to provide the sheet metal with a desired configuration.

It is a further object of the present invention to provide a method for forming exterior body panels for a motor vehicle. In accordance with this object, the present invention provides a method comprising mounting a sheet of metal material in a die assembly, clamping first peripheral portion of the sheet of metal material between clamping surfaces of the die assembly, moving the clamping surfaces relative to a central die structure so as to deform the sheet metal over the central die structure, clamping second peripheral portion of the sheet of metal material between a die pad of the die assembly and the central die structure after the sheet metal is deformed over the central die structure, moving the clamping surfaces relative to the central die structure to stretch the sheet metal over the central die structure after the second peripheral portion of the sheet of metal material are clamped, and stamping the sheet of metal material between the central structure and an opposing die surface after the sheet metal has been stretched over the die structure so as to provide the sheet metal with a desired configuration.

Other objects and advantages of the invention will become apparent from the following detailed description and appended drawings, wherein a preferred embodiment is illustrated.

DETAILED DESCRIPTION OF THE DRAWINGS

Figure 1:
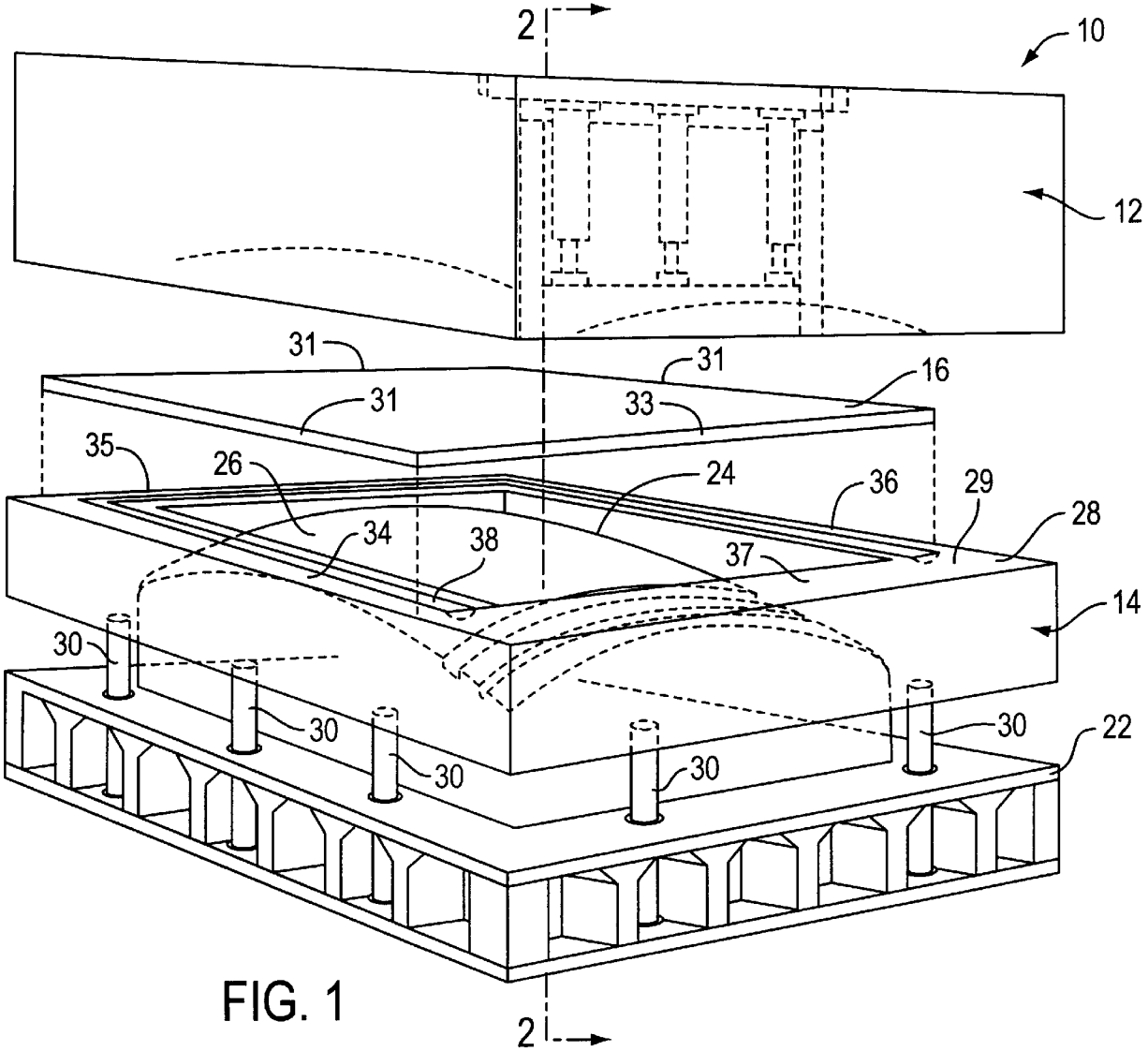
FIG. 1 is a perspective view of a sheet metal forming assembly showing an upper and lower die structure with a sheet metal blank to be formed therebetween in accordance with the present invention.

Referring now to the drawings and in particular FIG. 1, a sheet metal forming die assembly 10 is illustrated embodying the principles of the present invention. The sheet metal forming die assembly 10 (known as a deep draw assembly) includes first and second die assemblies. The first die assembly is a lower die assembly 14, and the second die assembly is an upper die assembly 12 which cooperate to form the metal sheet material 16 positioned therebetween. In the presently described embodiment, the sheet metal blank 16 has a substantially four-sided, rectangular configuration. It should be appreciated, however, that the present invention is not limited to sheet metal blanks of such configuration. The upper die assembly 12 is mounted in a conventional hydraulic of press (not shown) to enable upwards and downwards movement of the upper die assembly 12.

The lower die assembly 14 includes a lower horizontal support member or die shoe 22. A fixed dome-shaped central portion or die structure 24 of the lower die assembly 14 is carried by the lower die shoe 22. The fixed central die structure 24 has an upwardly facing die surface 26 in accordance with the desired shape of the sheet metal 16. A movable peripheral portion or clamping structure 28 of lower die assembly 14 surrounds the fixed central die structure 24 and is mounted on pneumatic spring members 30 extending upwardly from the lower die shoe 22. The spring members 30 bias the peripheral clamping structure 28 in an upwards direction. The movable peripheral clamping structure 28 has an upper surface 29, which is disposed slightly higher than the upper surface 26 of the structure 24 when the assembly is at rest (e.g. in FIGS. 1 and 2).

Figure 2:
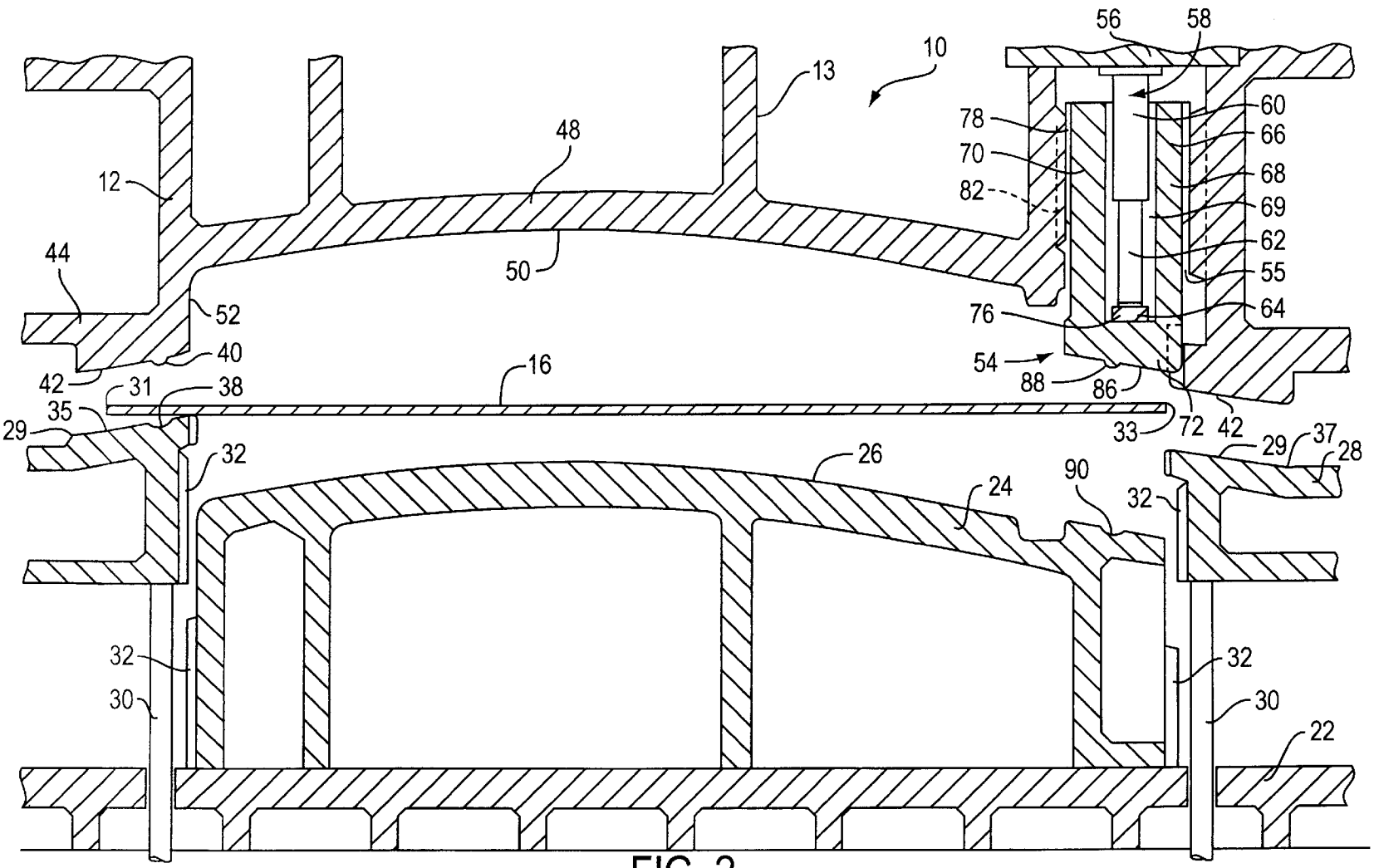
FIG. 2 is a partial sectional view of the sheet metal forming assembly showing the upper die structure raised above the lower die structure and the sheet metal resting along the movable peripheral portion of the lower die structure.

As shown in FIG. 2, hardened steal wear plates 32 provided at the interface between the movable peripheral clamping structure 28 and the fixed central die structure 24 serve to provide conventional guide and wear surfaces. In FIG. 2, the periphery of the sheet metal 16 is mounted onto the upper surface 29 of the movable peripheral clamping structure 28. More specifically, as can be appreciated from FIG. 1, the upper surface 29 has three upwardly facing peripheral surface areas 34, 35, and 36 which are constructed and arranged to engage the underside of the sheet metal adjacent three peripheral edges 31 of sheet metal 16. A fourth peripheral surface area 37 extends beyond the adjacent edge of the sheet metal 16 when the sheet metal 16 is properly mounted in the assembly 10. Thus, as can be appreciated from FIG. 2, one edge 33 of the sheet metal is left suspended above the fixed central structure 24. The three peripheral edges 31 constitute a first peripheral portion of the sheet metal 16, while the fourth peripheral edge 33 constitutes a second peripheral portion of the sheet metal 16, which first and second portions of sheet metal are formed differently in the die assembly 10, as will be described.

A groove 38 is formed in the aforementioned three surface areas 34, 35, and 36 of the movable peripheral clamping structure 28. The upper die assembly 12 has a peripheral portion 44 and a central portion 48. The peripheral portion 44 has a downwardly facing peripheral clamping surface 42 which forms a raised locking bead 40. The bead 40 is provided along three surface areas of the upper peripheral clamping surface 42 which are constructed and arranged to engage the three surface areas 34, 35, and 36 of the movable peripheral clamping structure 28. The bead 40 is disposed directly above the groove 38 and has substantially the same shape. The bead 40 and groove 38 come together in form-locking relation so as to lock a first peripheral portion of the sheet metal, including three peripheral sides 31 of the sheet metal 16 therebetween when the upper die assembly 12 is lowered.

The central portion 48 of upper die assembly 12 has a downwardly facing upper die stamping surface 50 surrounded by a vertical peripheral surface 52. The upper die surface 50 and lower die surface 26 have substantially inverted configuration with respect to one another so that the upper die surface 50 cooperates with the lower die surface 26 to stamp and form the central portion of the sheet metal material 16 therebetween when the upper die assembly 12 is lowered (e.g., see FIG. 5).

Figure 6:
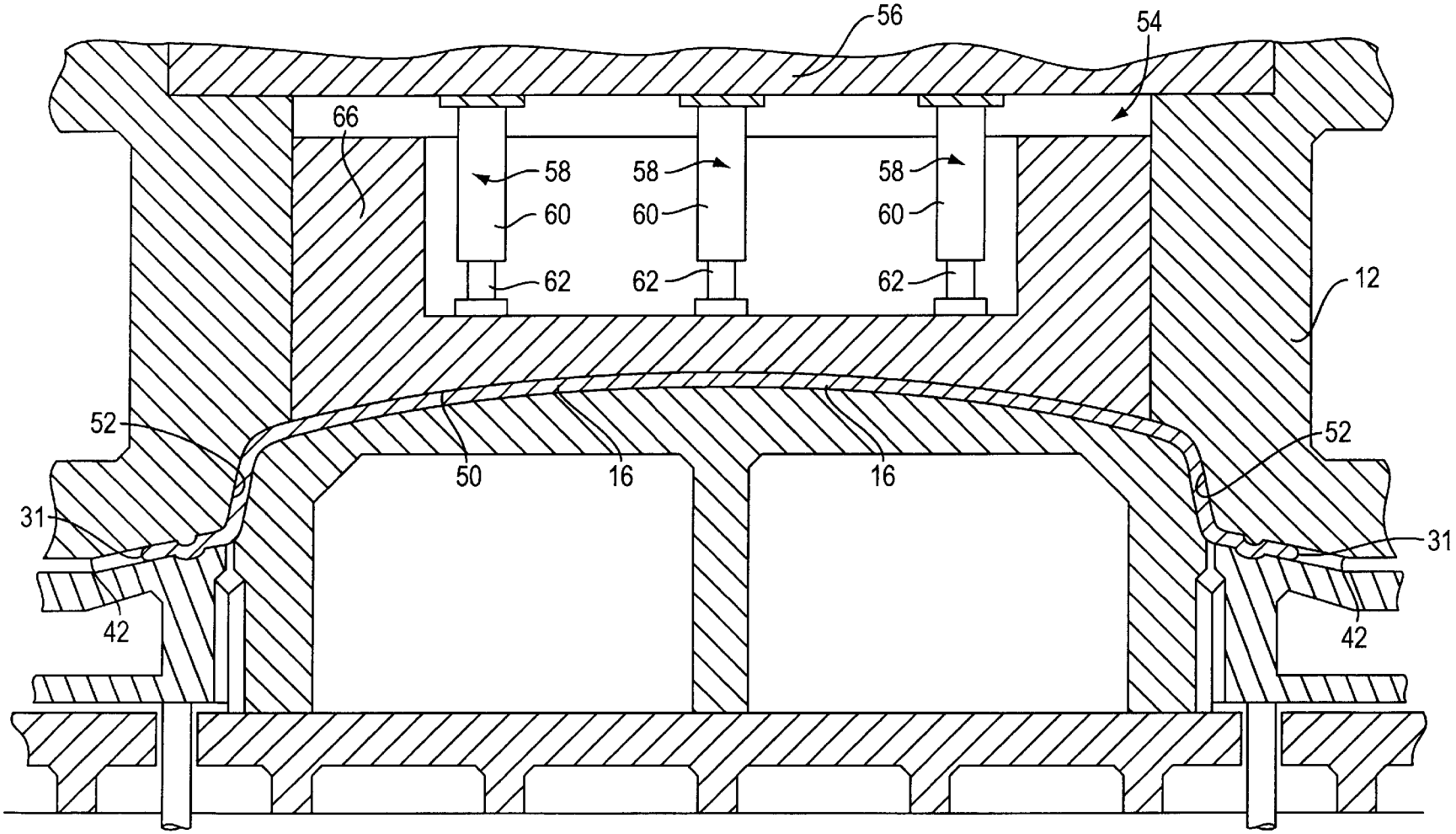
FIG. 6 is a partial sectional view which is taken orthogonally with respect to the sectional views of FIGS. 2–5, taken through the line 6—6 in FIG. 5, and showing the full length of the die pad assembly of the upper die structure.

The upper die assembly 12 comprises a main upper die structure 13 an independently movable upper die pad assembly generally shown at 54. More specifically, the movable upper die pad assembly 54 is received within a recess 55 in central portion 48 of the upper die structure 13. The movable upper die pad assembly 54 is attached to upper die structure 13 by means of an upper mounting plate 56. As best seen in FIG. 6, pneumatic cylinder members (preferably nitrogen spring cylinders) 58 are directly attached to the upper mounting plate 56 and extend vertically downwardly therefrom. Each pneumatic cylinder 58 comprises an upper cylinder portion 60 that telescopically receives a piston rod 62. The lower end of the piston rod 62 is attached to a pressure plate 64. A steel pressure die pad 66 of the movable upper die pad assembly 54 has a generally U-shaped cross-section defining an interior space 69 within which the cylinders 58 are received. The U-shaped section is defined by vertical walls 68 and 70 and horizontal base 72. The pressure plate 64 is attached interiorally to an inner surface 76 of the base 72 and forms the interconnection between the cylinders 58 and the die pad element 66.

The parallel walls 68 and 70 of the movable die pad element 66 have wear plates 78 along their outer surfaces which cooperate with wear plates 80 along the surfaces defining the recess 55 in the upper die central portion 48 to guide and direct the movable die pad 66.

The movable pad element 66 includes a lower die surface 86 which includes a raised locking bead 88. The locking bead 88 is positioned directly above a longitudinal groove 90 that is formed along the upper surface 26 of fixed die structure 24 at a position adjacent the fourth surface area 37 of the movable peripheral clamping structure 28 of the lower die assembly. The groove 90 is disposed under a peripheral side portion of the sheet metal 16 adjacent edge 33 and cooperates with the locking bead 88 to lock the aforementioned peripheral position of the sheet metal 16 therebetween as will be described in greater detail later.

Figure 3:
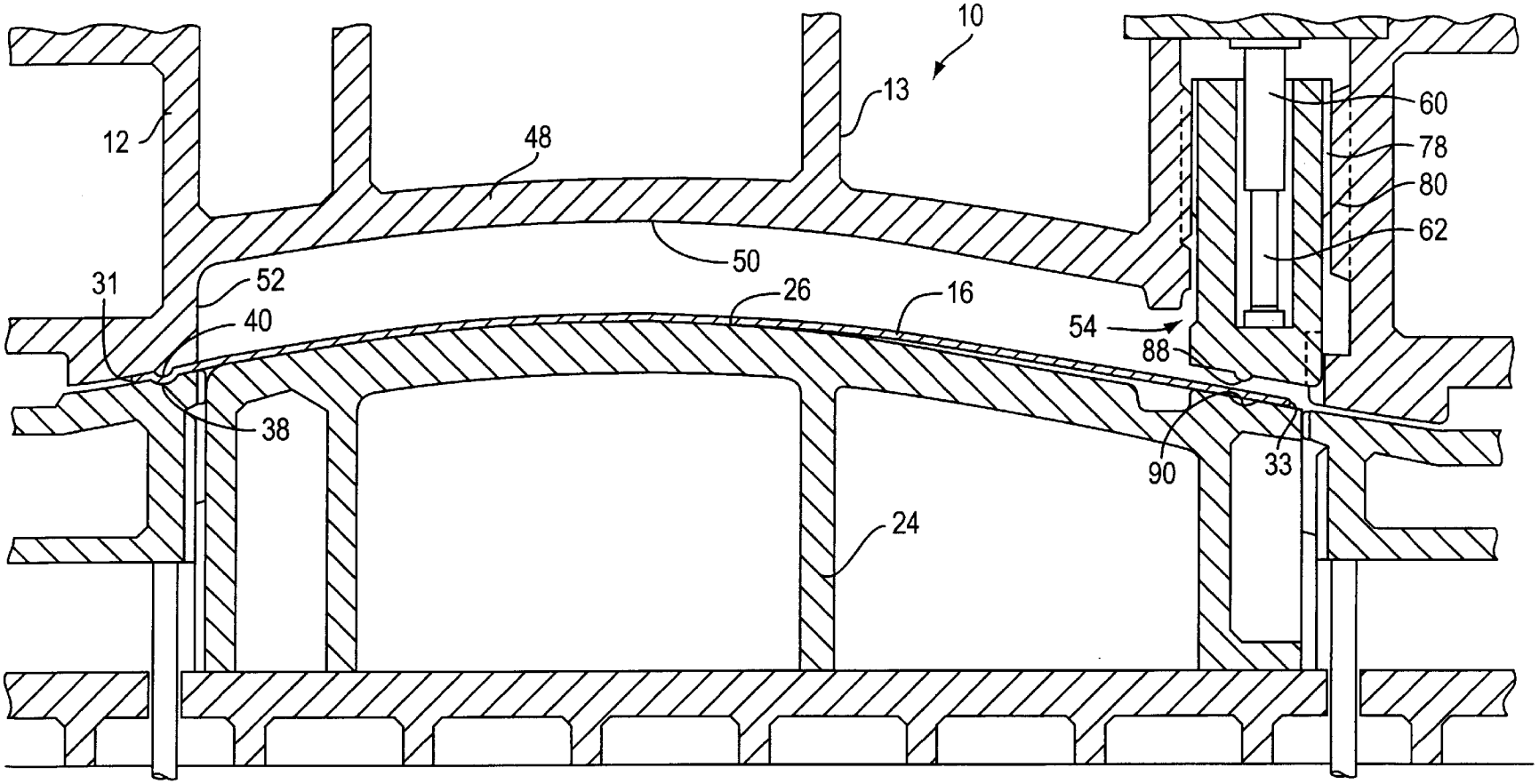
FIG. 3 is a partial sectional view similar to FIG. 2, but showing the upper die structure in a lowered position wherein it locks three peripheral sides of the sheet metal.

As can be appreciated in FIG. 3, when the upper die assembly 12 is moved downwardly under hydraulic force, the downwardly facing clamping surface 42 of peripheral portion 44 of the upper die assembly 12 engages the sheet metal 16 along three of peripheral side portions adjacent the three edges 31. Locking bead 40 cooperates with groove 38 to trap and lock the sheet metal 16 along the three peripheral portions adjacent edges 31. As also shown in FIG. 3, as the upper die assembly 12 continues to move downwardly, the movable peripheral clamping structure 28 of the lower die assembly 14 is forced downwardly against the bias of the pneumatic spring members 30. As the peripheral clamping structure 28 continues to be forced downwardly, the underside of the metal 16 eventually engages the upper surface 26 of the fixed central structure 24, and further downward movement of the upper die assembly 12 and peripheral clamping structure 28 causes the sheet metal 16 to be stretched over the fixed central structure 24.

Figure 4:
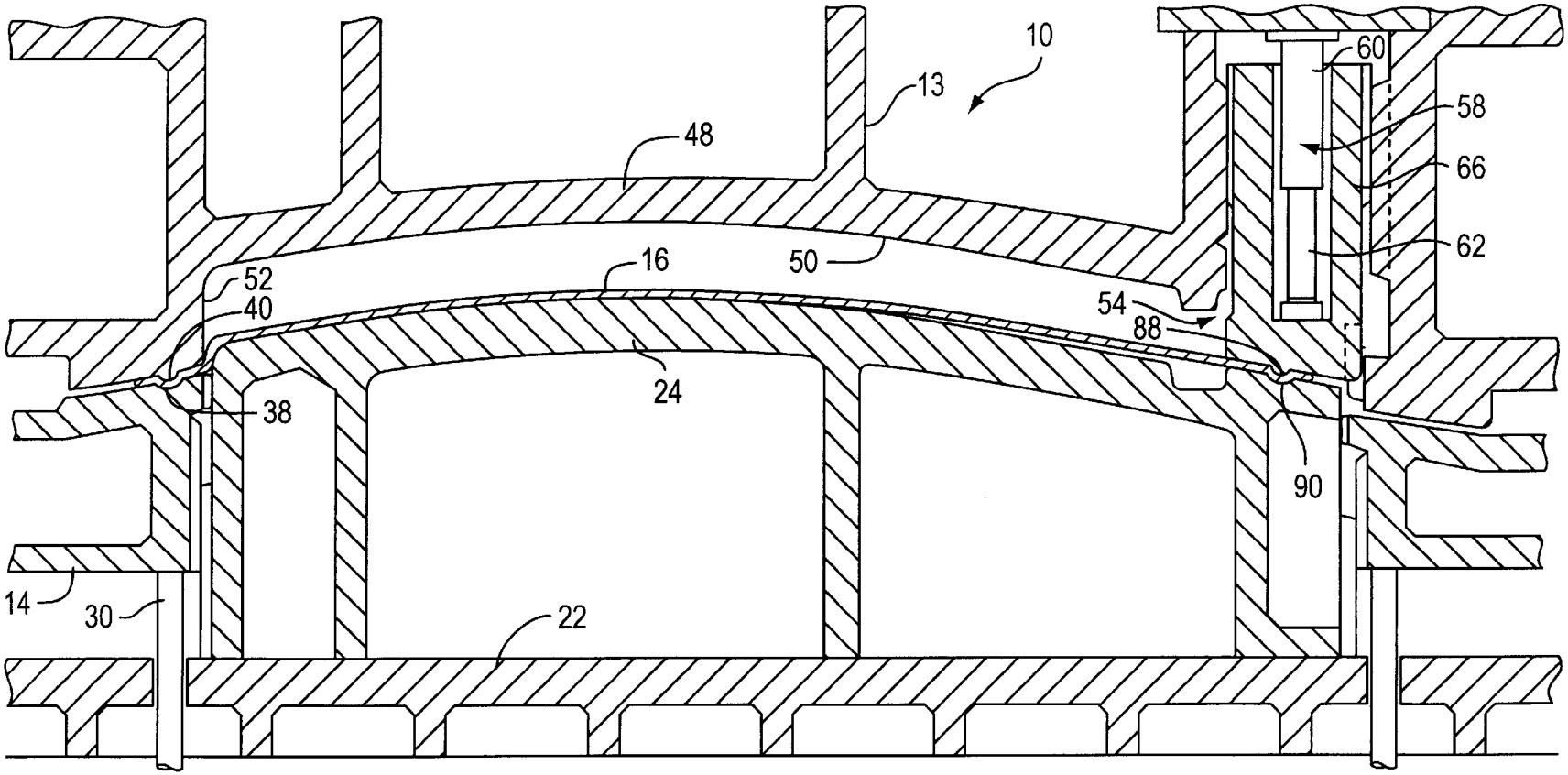
FIG. 4 is a partial sectional view similar to FIG. 3, but showing a movable die pad assembly of the upper die structure locking the sheet metal in place along the fourth peripheral side.

After a slight deformation of the sheet metal 16 over the fixed central structure 24 as shown in FIG. 3, or perhaps even after a slight stretching of the sheet metal 16 over the fixed central die structure 24 as shown in FIG. 4, the pad element 66 engages and clamps the fourth portion adjacent edge 33 of sheet metal 16 against the upper surface 26 of the fixed central die member 24 ash shown in FIG. 4. This locking or clamping of the fourth peripheral portion of sheet metal 16 is facilitated by the cooperating locking bead 88 and groove 90. The movable die pad element 66 engages the peripheral portion adjacent edge 33 of the sheet metal 16 which is formed into a portion of the final stamped product which is not provided with any significant structural depth, and in any event, less structural depth than the other three edge portions 31, and thus need not be stretched to any significant extent.

It will be appreciated by those skilled in the art that the locking bead 88 and groove 90 arrangement and the locking bead 40 and groove 38 arrangement operate such that stretching of the central portion of sheet metal 16 over fixed die structure 24 is substantially limited to portions of the sheet metal within the four line boundaries defined by these locking beads and grooves.

Figure 5:
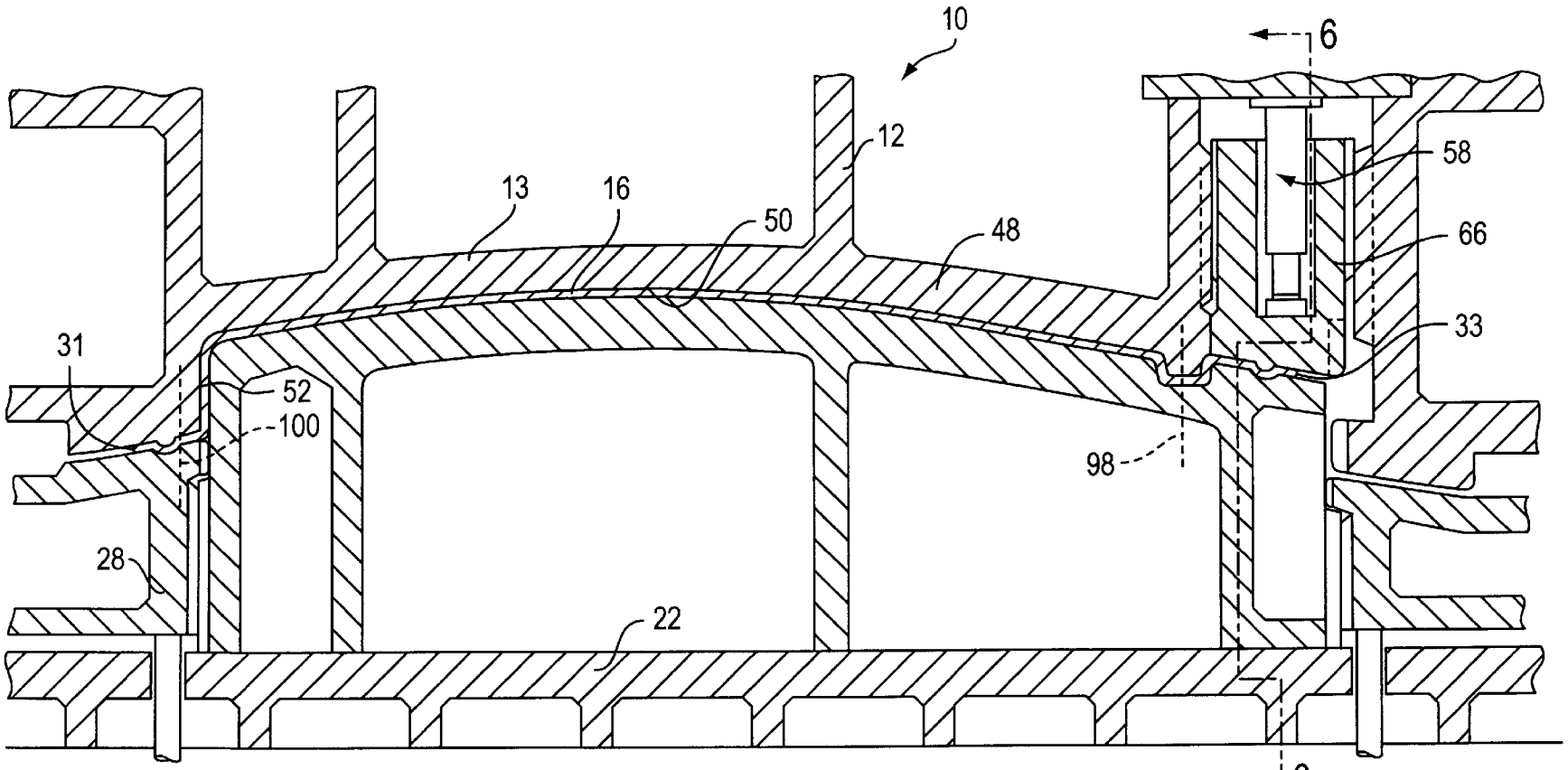
FIG. 5 is a partial sectional view similar to FIG. 4, but showing the upper die structure in a fully lowered configuration wherein the sheet metal is stretched and stamped into its desire configuration.

As shown in FIG. 5, continued lowering of the upper die assembly 12 and lower peripheral clamping structure 28 causes continued stretching of the sheet metal 16 until the upper central die surface 50 and vertical peripheral surface 52 move downwardly into engagement with the upper surface of the metal sheet 16. In addition, cylinders 58 are compressed, with rod 62 extending into cylindrical portion 60 against the outward bias thereof to further enhance the gripping force applied by pad 66. At the end of the stretching operation, the die surfaces stamp the sheet metal 16 and provide a final form for the sheet metal structure. The stretching of the sheet metal during the draw operation results in work hardening of the metal material to enhance the strength thereof.

After the drawing and stamping operation, the excess sheet metal is cut off along dashed lines 98 and 100 in FIG. 5.

From the above, it should be appreciated that the present invention provides a die assembly 10 for draw stamping sheet metal 16 in a press for forming an exterior body panel for a motor vehicle. The die assembly includes a first die assembly 14 including a central first die structure 24 constructed and arranged to engage one surface of the sheet metal during a stamping operation. The first die assembly 14 further includes a movable peripheral clamping structure 28 which is movable with respect to the first die structure 24 and constructed and arranged to engage first peripheral portion 31 of the sheet metal 16. The second die assembly 12 includes a second die structure 13 having a central stamping surface 50 constructed and arranged to engage an opposite surface of the sheet metal 16 during the stamping operation. The second die structure 13 includes a peripheral clamping surface 42 constructed and arranged to cooperate with the movable clamping structure 28 to clamp the first peripheral portion 31 of the sheet metal 16 therebetween. The second die assembly further includes a movable die pad assembly 54 which is movable with respect to the second die structure 13. The movable die pad assembly 54 is cooperable with the first die structure 24 to clamp second peripheral portion 33 of the sheet metal 16 therebetween. The first and second die assemblies 14 and 12, respectively, are constructed and arranged to be mounted in a press, the second die assembly 12 being movable by the press so that the peripheral clamping surface 42 thereof cooperates with the movable clamping structure 28 of the first die assembly 14 to clamp the first peripheral portion 31 of the sheet metal 16 therebetween. The peripheral clamping surface 42 and the movable clamping structure 28 are moved with the first peripheral portion 31 of sheet metal clamped therebetween to deform the sheet metal 16 over the central first die structure 24. The movable die pad assembly 54 is movable relative to the second die structure 13 and towards the first die structure 24 so as to clamp the second peripheral portion 33 of the sheet metal 16 between the movable die pad assembly 54 and the first die structure 24 after the sheet metal is deformed over the central first die structure 24. The peripheral clamping surface 42 and the movable clamping structure 28 are movable to stretch the sheet metal over the central first die structure 24. The central stamping surface 50 is cooperable with the central first die structure 24 to stamp the sheet metal therebetween after the sheet metal has been stretched over the central first die structure 24 so as to provide the sheet metal with a desired configuration.

In FIG. 6, the independently movable die component 54 is shown with pad element 66 engaging the sheet metal 16 along the peripheral portion adjacent edge 33. The upper die assembly 12 has been moved downwardly to its lowermost point, and the sheet metal 16 has been formed into its final shape. It can be appreciated that the longitudinal extent of movable element 66 does not traverse across the entire length of the upper surface 26 of fixed central die structure 24. Rather, the opposite ends of the sheet metal 16 are engaged by the surfaces portion 52 of the upper die assembly which forms a transition between the central surface portion 50 and peripheral surface portion 42 of upper die assembly 12.

In accordance with the principles of the present invention, the initial stretching and forming of sheet metal 16 as shown in FIG. 3 occurs sometime before the movable element 66 engages and locks the sheet metal 16 at peripheral portion adjacent edge 33. This order of engagement is important in order to preserve and maintain the ornamental nature of the finished sheet metal product which can be used as a class A motor vehicle body outer panel. More specifically, the die assembly in accordance with the present invention is particularly constructed and arranged to minimize surface skid marks and scratches that can occur during the stamping and stretching process, and is also constructed and arranged to reduce, or prevent distortion of the panel, which would be unsuitable for the final surface finish, including painting, of class A outer panel requirements.

As can be appreciated from FIG. 5, since structural depth of the resultant formed structure is only required along the three peripheral portions of the sheet metal adjacent edges 31, and is not required along the fourth peripheral portion adjacent edge 33, stretching the sheet metal need not be accomplished along the side portion adjacent edge 33. Because the material is not stretched at the side portion adjacent edge 33, a greater amount of stretching can be accomplished adjacent the remaining three edges 31. Thus, the same desired resultant part can be manufactured from less material in comparison with an arrangement in which the fourth side portion adjacent edge 33 of insignificant required part depth is stretched to the same depth as the remaining three side portions and then cut-off as scrap.

Figure 7:
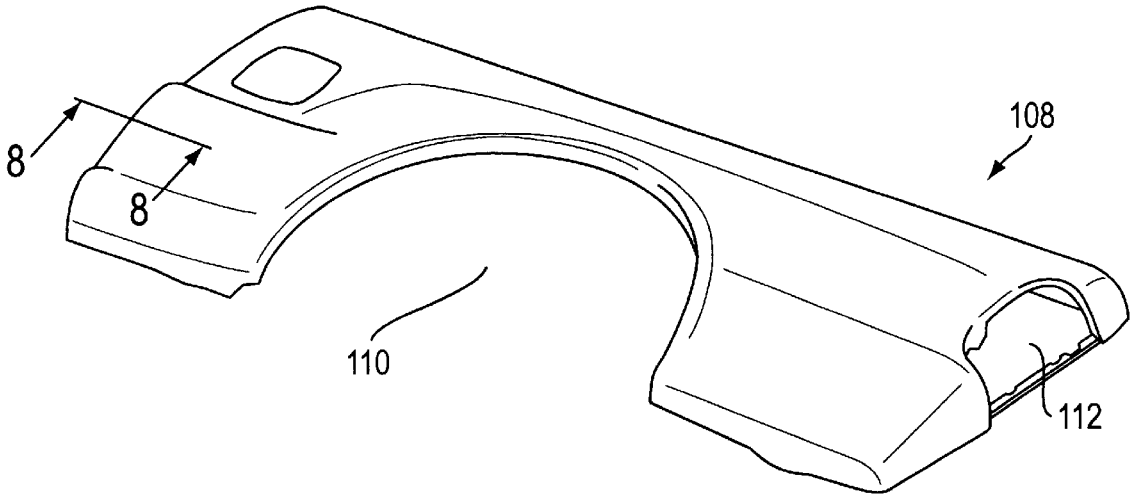
FIG. 7 is a perspective view of an exterior body panel forming the exterior side surface of a rear box for a pick-up truck which has been formed in accordance with the present invention.
Figure 8:
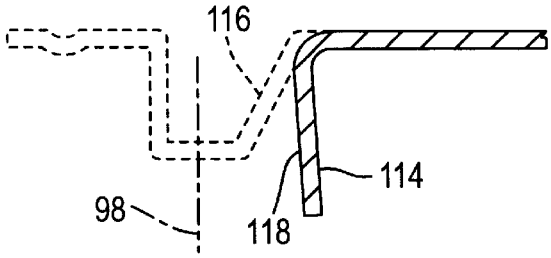
FIG. 8 is a cross-sectional view taken through the line 8—8 in FIG. 7, and showing the position of this section in relation to the stamped sheet metal.

FIG. 7 is a perspective view of a preferred exterior body panel made in accordance with the present invention. The body panel is in the form of a rear side panel generally indicated at 108 for the rear box of a pick-up truck. As shown, after the sheet metal is stamped or drawn, it is cut and formed into its final configuration. For example, in the preferred embodiment shown, a wheel opening 110 and an opening 112 for a rear light is formed. The front end portion of the panel 108 is formed into a flange 114, as can be appreciated from the cross-sectional view in FIG. 8, taken through line 8—8 in FIG. 7. It can be appreciated from FIG.

8 that the flange 114 is formed by bending the end portion 116 of the sheet metal after it has been cut off along line 98. After the end portion 116 is bent into the desired configuration for the exterior panel for the rear box, the exterior surface 118 of the flange 114 is mated to a rear surface on the cab portion of a pick-up truck. The sheet metal is then painted in a conventional painting station, together with the rest of the vehicle.

Additional advantages and modifications will readily occur to those skilled in the art. Therefore, the present invention is not limited to the specific details and embodiment shown and described herein. Accordingly, various modifications to the embodiment and details described may be made without departing from the principles, spirit, and scope of the present invention, as set forth in the appended claims.

What is claimed is:

1. A die assembly for draw stamping sheet metal in a press for forming an exterior body panel for a motor vehicle, the die assembly comprising:

a first die assembly including a central first die structure constructed and arranged to engage one surface of the sheet metal during a stamping operation, the first die assembly further including a movable peripheral clamping structure which is movable with respect to the first die structure and constructed and arranged to engage a first peripheral portion of the sheet metal;

a second die assembly including a second die structure having a central stamping surface constructed and arranged to engage an opposite surface of the sheet metal during the stamping operation, the second die structure including a peripheral clamping surface constructed and arranged to cooperate with the movable clamping structure to clamp the first peripheral portion of the sheet metal therebetween, said second die assembly further including a movable die pad assembly which is movable with respect to the second die structure, the movable die pad assembly being cooperable with the first die structure to clamp second peripheral portion of the sheet metal therebetween, said first and second die assemblies constructed and arranged to be mounted in a press, the second die assembly being movable by the press so that the peripheral clamping surface thereof cooperates with the movable clamping structure of the first die assembly to clamp the first peripheral portion of the sheet metal therebetween, said peripheral clamping surface and said movable clamping structure being moved with the first portions of sheet metal clamped therebetween to deform the sheet metal over the central first die structure, said movable die pad assembly being movable relative to the second die structure and towards the first die structure so as to clamp the second portions of the sheet metal between the movable die pad assembly and the first die structure after the sheet metal is deformed over the central first die structure, said peripheral clamping surface and said movable clamping structure being moved to stretch the sheet metal over the central first die structure, said central stamping surface being cooperable with said central first die structure to stamp the sheet metal therebetween after the sheet metal has been stretched over the central first die structure so as to provide the sheet metal with a desired configuration.

2. A die assembly according to claim 1, wherein the die pad assembly includes a die pad and at least one spring member which mounts the die pad for movement relative to the second die structure.

3. A die assembly according to claim 2, wherein the first die assembly further comprises a plurality of spring members which mount the movable clamping structure for movement.

4. A die assembly according to claim 3, wherein the second die structure is constructed and arranged to be mounted on a press upper ram and is lowered until the clamping surface thereof engages the sheet metal and clamps the sheet metal against the movable clamping structure, and wherein continued lowering of the second die structure causes the movable clamping structure to be moved downwardly against the bias of the plurality of spring members until the sheet metal is deformed over the central first die structure.

5. A die assembly according to claim 4, wherein the die pad is moved against a spring bias of the at least one spring member after the die pad clamps the sheet metal against the first die structure.

6. A die assembly according to claim 2, wherein the second die structure has a recess, and wherein the at least one spring member and the die pad are disposed within the recess.

7. A die assembly according to claim 6, wherein the second die structure has a mounting plate within the recess, and wherein one end of the at least one spring member is fixed to the mounting plate, and wherein an opposite end of the at least one spring member is fixed to the die pad.

8. A method for forming an exterior body panel for a motor vehicle comprising:

mounting a sheet of metal material in a die assembly, said sheet metal having a surrounding edge including opposing first and second edge portions, clamping a first peripheral portion of the sheet of metal material including said first edge portion between clamping surfaces of the die assembly, moving the clamping surfaces relative to a central die structure so as to deform the sheet metal over the central die structure, clamping a second peripheral portion of the sheet of metal material including said second edge portion between a die pad of the die assembly and the central die structure after the sheet metal is deformed over the central die structure, moving the clamping surfaces relative to the central die structure to stretch the sheet metal over the central die structure after the second peripheral portion of the sheet of metal material are clamped, stamping the sheet of metal material between the central structure and an opposing die surface after the sheet metal has been stretched over the die structure so as to provide the sheet metal with a desired configuration.

9. A method according to claim 8, further comprising painting the sheet of metal material subsequent to the stamping.

10. A method according to claim 8, wherein the die assembly comprise a lower die assembly and an upper die assembly, and the clamping surfaces of the die assembly comprise lower clamping surfaces provided on a movable peripheral clamping structure of the lower die assembly and upper clamping surfaces provided on the upper die assembly, the clamping of the first peripheral portion being accomplished by lowering the upper die assembly so that the upper clamping surfaces thereof are moved toward the lower clamping surfaces so as to clamp the first peripheral portion of the sheet of metal material therebetween.

11. A method according to claim 10, wherein deforming of the sheet metal over the central die structure is accomplished by moving the upper die assembly and the peripheral clamping structure of the lower die assembly relative to the central die structure while the first peripheral portion of the sheet of metal material are clamped between the upper and lower clamping surfaces, so that one side of the sheet of metal material is deformed into generally conforming engagement with an upper surface of the central die structure.

12. A method according to claim 11, wherein the die pad is connected with the upper die assembly, and the central die structure forms part of the lower die assembly, and wherein the clamping of the second peripheral portion of the sheet of metal material between the die pad and the central die structure is accomplished by the lowering of the upper die assembly until the die pad cooperates with the central die structure to clamp the sheet of metal material therebetween after the sheet of metal material is deformed into the generally conforming engagement with the upper surface of the central die structure.

13. A method according to claim 11, wherein the sheet of metal material is slightly stretched after it is deformed into the generally conforming engagement with the upper surface of the central die structure.

14. A method according to claim 12, wherein the opposing die surface is lowered with the upper die assembly as the sheet of metal material is being stretched over the central die, the upper die assembly continuing to be lowered until the opposing die surface engages the sheet of metal material to stamp the sheet of metal material between the upper surface of the central die structure and the opposing die surface.

15. A method according to claim 8, wherein said clamping surfaces of the die assembly cooperate to form a locking bead constructed and arranged to lock said sheet metal, and wherein said die pad and the central die structure cooperate to form a locking bead constructed and arranged to lock said sheet metal, said locking beads engaging said sheet metal at positions defining boundaries within which said sheet metal is stretched.

16. A method according to claim 8, wherein after said stamping, said sheet of metal material is removed from said die assembly, and wherein peripheral portions of said sheet of metal material, including said positions thereof defining said boundaries, are cut from central portions of said sheet of metal material.

17. A method according to claim 16, wherein after said peripheral portions of said sheet metal are cut, said sheet metal is bent into a desired configuration for an exterior panel for a rear box of a pick-up truck.

18. A method according to claim 17, further comprising painting the sheet of metal material subsequent to said bending into said desired configuration for said exterior panel.

* * * * *